US006526724B1

(12) United States Patent
Tazaki et al.

(10) Patent No.: US 6,526,724 B1
(45) Date of Patent: Mar. 4, 2003

(54) APPARATUS FOR PACKAGING MULTIPLE PACKAGING MATERIAL

(75) Inventors: Ribun Tazaki, Tsurugashima (JP); Kenichi Nakabayashi, Tsurugashima (JP)

(73) Assignee: Daisey Machinery Co., Ltd., Tsurugashima (JP)

( * ) Notice: Subject to any disclaimer, the term of this patent is extended or adjusted under 35 U.S.C. 154(b) by 0 days.

(21) Appl. No.: 09/629,429

(22) Filed: Jul. 31, 2000

(30) Foreign Application Priority Data

Aug. 4, 1999 (JP) ..... 11-221245

(51) Int. Cl.[7] ..... B65B 41/18

(52) U.S. Cl. ..... 53/173; 53/560; 53/208; 53/240

(58) Field of Search ..... 53/560, 563, 173, 53/174, 208, 237, 240, 89

(56) References Cited

U.S. PATENT DOCUMENTS 3,745,742 A * 7/1973 Tartarini
4,024,694 A * 5/1977 Cooper et al.
4,162,599 A * 7/1979 Kyle
4,165,594 A * 8/1979 Corbic
4,624,099 A * 11/1986 Harder
5,077,954 A * 1/1992 Williams
5,155,973 A * 10/1992 Hipko et al.

* cited by examiner

*Primary Examiner*—Eugene Kim
*Assistant Examiner*—Sameh Tawfik
(74) *Attorney, Agent, or Firm*—Oblon, Spivak, McClelland, Maier & Neustadt, P.C.

(57) ABSTRACT

Packaging method and apparatus using multiple packaging material are improved so that multiple packaging filled with goods and sealed may be separated easily to each goods filling section. The multiple packaging material (40, 50) has plural goods filling sections connected in series via adjacent side edge portion (42, 52, 53) between each of the goods filling sections. Goods to be packaged are filled in the multiple packaging material at goods filling portion (12). Multiple packaging so filled with the goods is covered and sealed with sheet coming from master roll (16). The multiple packaging is made separable at the adjacent side edge portion. Overlapped portion of outer peripheral edge portion (41, 51) of the multiple packaging material and the sheet is first sealed at sealing portion (14) and then the adjacent side edge portion is sealed with the sheet at longitudinal sealing portion (21). The sheet on the adjacent side edge portion is cut and the adjacent side edge portion is scratched both at scratching portion (22) so that scratched portion (43, 54, 55) is formed on upper and lower surfaces of the adjacent side edge portion.

14 Claims, 3 Drawing Sheets

A
B
C
D
30

40

50

31
41
51
42
52
53
43
54
55

APPARATUS FOR PACKAGING MULTIPLE PACKAGING MATERIAL

BACKGROUND OF THE INVENTION

1. Field of the Invention

The present invention relates generally to a packaging method and apparatus using a multiple packaging material for obtaining multiple packaged goods and more particularly to a packaging method and apparatus for effecting packaging such that, where the multiple packaging material has a plurality of goods filling sections connected in series via an adjacent side edge portion between each of the goods filling sections, goods to be packaged are filled in the goods filling sections of the multiple packaging material and are packaged with the multiple packaging material being covered with a sheet and each of the goods filling sections is made separable at the adjacent side edge portion.

2. Description of the Prior Art

As is often talked by the words "meal eating by oneself", it is a recent tendency that foods are consumed in a quantity small by small. As one example, while tofu, or bean curd, has been consumed in the unit of one piece, it is often done that tofu of one piece is consumed only in a ½ or ⅓ thereof at one time with the remainder being stored in a refrigerator. Thus, in order that goods may be consumed in the unit of a small package, it is done that the goods are filled to be packaged in a multiple packaging material having a plurality of small filling sections, wherein the small filling sections are connected in series via an adjacent side edge portion between each of the small filling sections so that each of the small filling sections may be separated from each other at the adjacent side edge portion.

In the packaged goods using the multiple packaging material, however, there is a problem that the adjacent small packages have to be separated by scissors or some of the small packages being sealed insufficiently, juice may come out of those small packages remaining after used and it is still a present situation that there is established no sufficient art for ensuring packaging using the multiple packaging material so as to be easily usable by consumers. Thus, a packaging art using the multiple packaging material, which enables a secure sealing and yet is usable easily, is desired.

Also, a packaging art using the multiple packaging material is desired such that an existing packaging device using the multiple packaging material may be used effectively as it is with an improvement being added so as to enable a multiple packaging to meet "meal eating by oneself".

SUMMARY OF THE INVENTION

In view of the problems in the prior art, it is an object of the present invention to provide a packaging method and apparatus using a multiple packaging material, by which multiple packaged goods may be obtained easily by effecting packaging such that, where the multiple packaging material has a plurality of goods filling sections connected in series via an adjacent side edge portion between each of the goods filling sections, goods to be packaged are filled in the goods filling sections of the multiple packaging material and are packaged with the multiple packaging material being covered with a sheet and each of the goods filling sections is made separable at the adjacent side edge portion.

It is also an object of the present invention to provide a packaging method and apparatus using a multiple packaging material for effecting packaging such that a conventional multiple packaging device is used as it is and a multiple packaging is obtained with each of goods filling sections of the multiple packaging material being made separable at an adjacent side edge portion between each of the goods filling sections.

In order to attain the mentioned objects, the present invention provides the following packaging method:

A packaging method using a multiple packaging material for obtaining multiple packaged goods by effecting packaging such that, where the multiple packaging material has a plurality of goods filling sections connected in series via an adjacent side edge portion between each of the goods filling sections, goods to be packaged are filled in the goods filling sections of the multiple packaging material and are packaged with the multiple packaging material being covered with a sheet and each of the goods filling sections is made separable at the adjacent side edge portion, characterized in comprising steps of;

sealing an overlapped portion of an outer peripheral edge portion of the multiple packaging material and the sheet;

then sealing the adjacent side edge portion of the multiple packaging material with the sheet; and cutting the sheet on the adjacent side edge portion as well as forming a scratched portion for separation in the adjacent side edge portion.

According to the packaging method of the present invention, the overlapped portion of the outer peripheral edge portion of the multiple packaging material and the sheet is first sealed, like in the conventional multiple packaging, and then the adjacent side edge portion of the multiple packaging material is sealed with the sheet and the cutters arranged to abut on the adjacent side edge portion cut the sheet on the adjacent side edge portion as well as scratch the adjacent side edge portion. Thereby, when the multiple packaging material is bent at the adjacent side edge portion, each of the goods filling sections, as sealed, may be separated easily.

The packaging method of the present invention, as mentioned above, may be readily realized only by using a conventional multiple packaging device which effects packaging by sealing an outer peripheral edge portion of the multiple packaging material with a sheet and providing downstream thereof a device for sealing the adjacent side edge portion of the multiple packaging material with the sheet and for cutting the sheet on the adjacent side edge portion and scratching the adjacent side edge portion.

Also, in order to attain the mentioned objects, the present invention provides the following packaging apparatus:

A packaging apparatus using a multiple packaging material, characterized in comprising; a multiple packaging portion for effecting packaging such that, where the multiple packaging material has a plurality of goods filling sections connected in series via an adjacent side edge portion between each of the goods filling sections, goods to be packaged are filled in the goods filling sections of the multiple packaging material and are packaged with the multiple packaging material being covered with a sheet, and with an overlapped portion of an outer peripheral edge portion of the multiple packaging material and the sheet being sealed; a longitudinal sealing portion for sealing an overlapped portion of the adjacent side edge portion of the multiple packaging material, which has come out of the multiple packaging portion, and the sheet; and a scratching portion for forming a scratched portion in the adjacent side edge portion.

According to the packaging apparatus of the present invention, in addition to a conventional multiple packaging device, such a device is provided as comprising the longitudinal sealing portion for sealing the overlapped portion of the adjacent side edge portion of the multiple packaging material and the sheet, and the scratching portion for forming the scratched portion in the adjacent side edge portion of the multiple packaging material, thereby the multiple packaging in which each of the goods filling sections may be separated easily, as desired, can be realized.

Also, in the packaging apparatus of the present invention, if the longitudinal sealing portion and the scratching portion for performing the sealing and scratching of the adjacent side edge portion are constructed changeable for a single packaging material and a multiple packaging material, it will be preferable as a packaging apparatus changeable for the conventional packaging using the single packaging material and the packaging using the multiple packaging material can be obtained.

DESCRIPTION OF THE PREFERRED EMBODIMENTS

Figure 1:
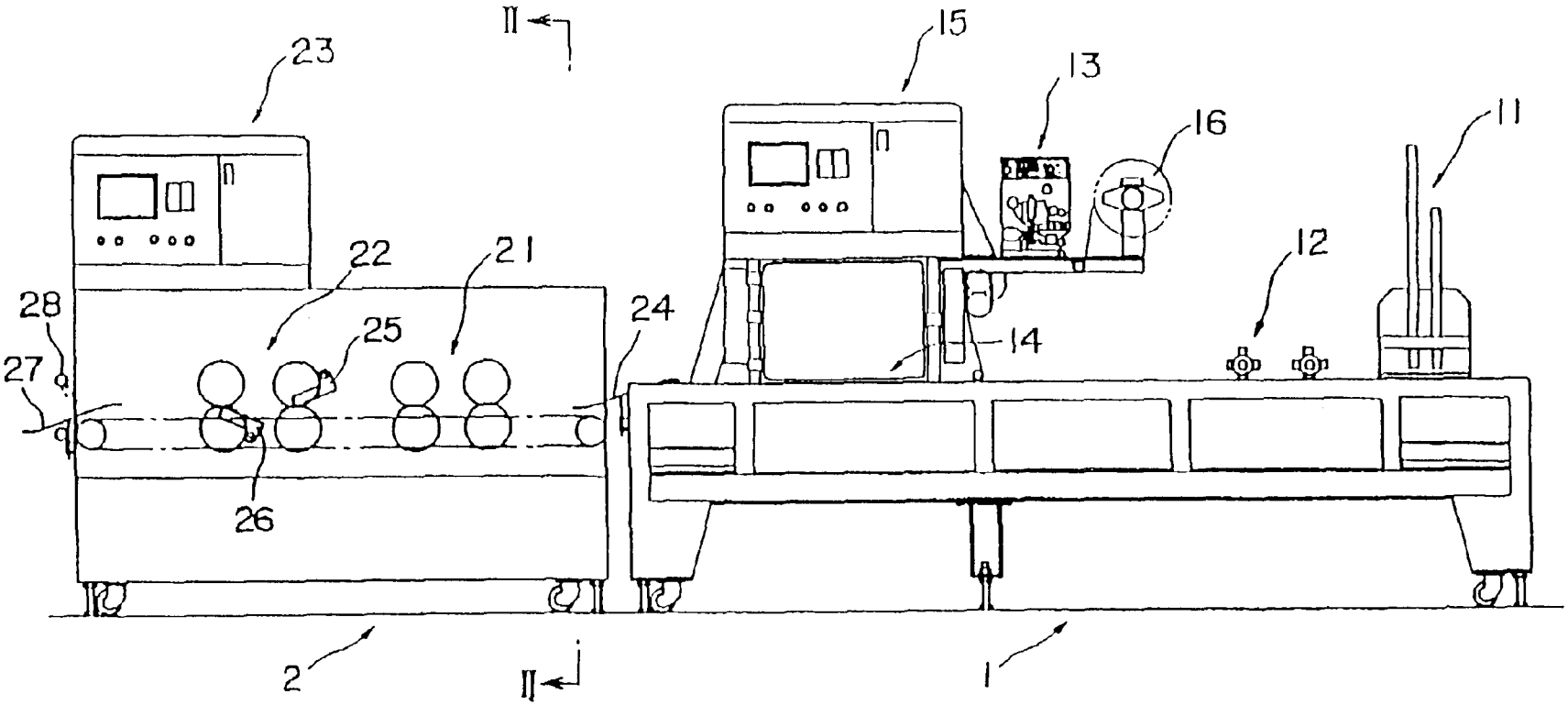
FIG. 1 is a side view showing an entire construction of a packaging apparatus of an embodiment of the present invention.
Figure 2:
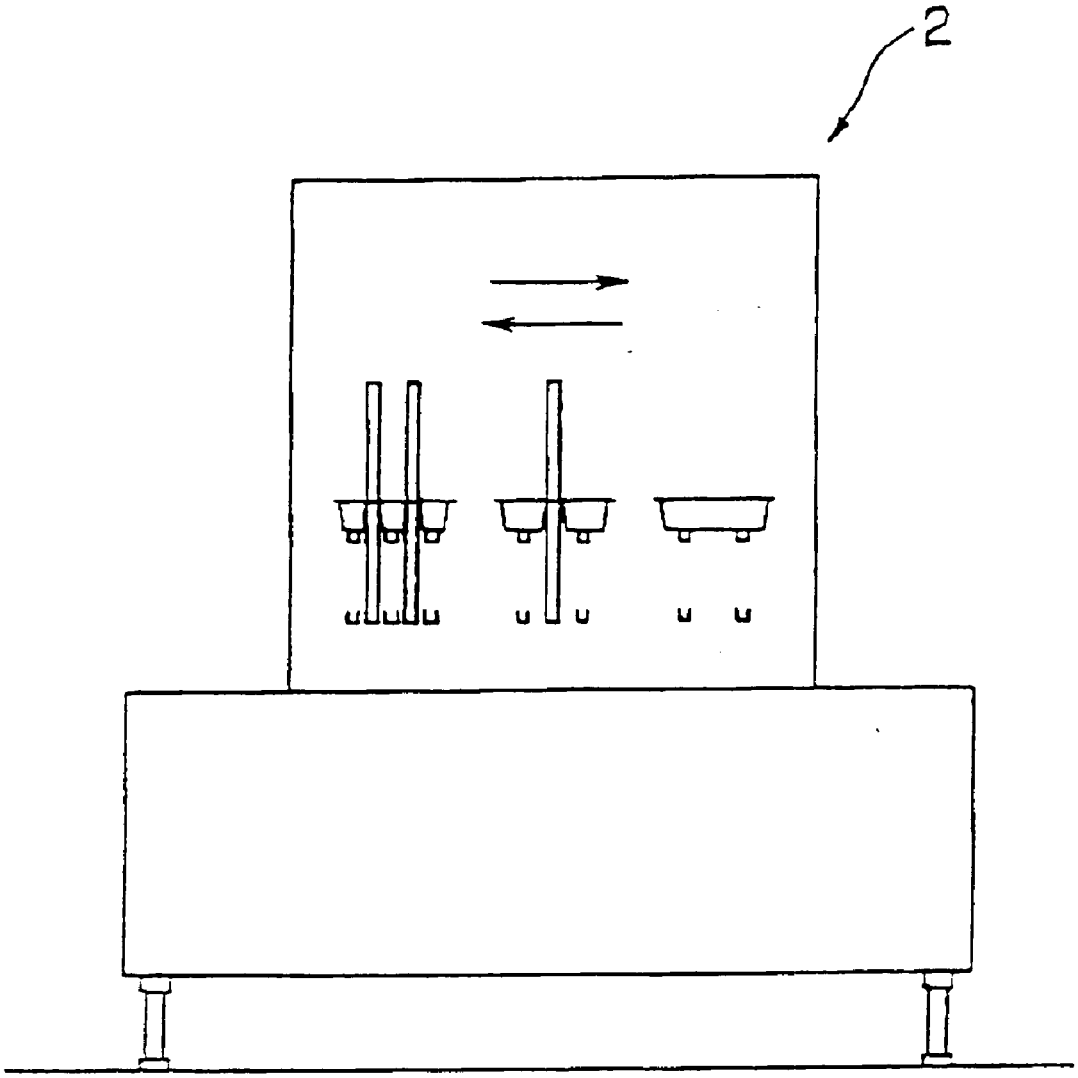
FIG. 2 is a cross sectional view taken on line II—II of FIG. 1 and seen in the arrow direction.

Herebelow, the present invention will be described base on an embodiment as illustrated. FIG. 1 is a side view showing an entire construction of a packaging apparatus of the embodiment of the present invention and FIG. 2 is a cross sectional view taken on line II—II of FIG. 1 and seen in the arrow direction. In FIGS. 1 and 2, numeral 1 designates a multiple packaging device and numeral 2 designates a longitudinal sealing/scratching device. The multiple packaging device 1 may be such an ordinary multiple packaging device as is conventionally used and comprises a multiple packaging material supply portion 1, a goods filling portion 12, a letter printing portion 13 for printing letters on a sheet which is used for covering the multiple packaging material, a sealing portion 14 for sealing an overlapped portion of the sheet placed on the multiple packaging material and an outer peripheral edge portion of the multiple packaging material and a control portion 15. Numeral 16 designates a master roll of the sheet.

On the other hand, the longitudinal sealing/scratching device 2 comprises a longitudinal sealing portion 21, a scratching portion 22 and a control portion 23. The longitudinal sealing portion 21 comprises a roll seal device having a roll-shaped sealer. By this roll-shaped sealer, the sheet and an adjacent side edge portion between each of goods filling sections of the multiple packaging material are pinched together upward and downward so that an overlapped portion of the sheet and the adjacent side edge portion of the multiple packaging material are sealed.

The scratching portion 22 comprises cutters 25, 26, which abut on upper and lower surfaces of the adjacent side edge portion of the multiple packaging material so sealed with the sheet at the longitudinal sealing portion 21. Of the cutters 25, 26 so abutting on the adjacent side edge portion, the cutter 25 on the upper side cuts the sheet on the adjacent side edge portion and, at the same time, scratches the upper surface of the adjacent side edge portion. Also, the cutter 26 on the lower side is arranged so as to scratch the lower surface of the adjacent side edge portion at the position corresponding to the scratched portion of the upper surface of the adjacent side edge portion.

The packaging apparatus of FIGS. 1 and 2 so constructed as mentioned above is operated as follows:

Firstly, in the multiple packaging device 1, the multiple packaging material is supplied, one piece by one piece, onto a carrying conveyor (not shown) from the multiple packaging supply portion 11 to be conveyed to the left hand direction in FIG. 1. When the multiple packaging material comes to the goods filling portion 12, goods to be packaged are filled in the goods filling sections of the multiple packaging material.

The multiple packaging material so filled with the goods is covered with the sheet, on which predetermined letters have been printed at the letter printing portion 13, so that the outer peripheral edge portion of the multiple packaging material and the sheet placed thereon are sealed together by melting at the sealing portion 14.

Figure 3:
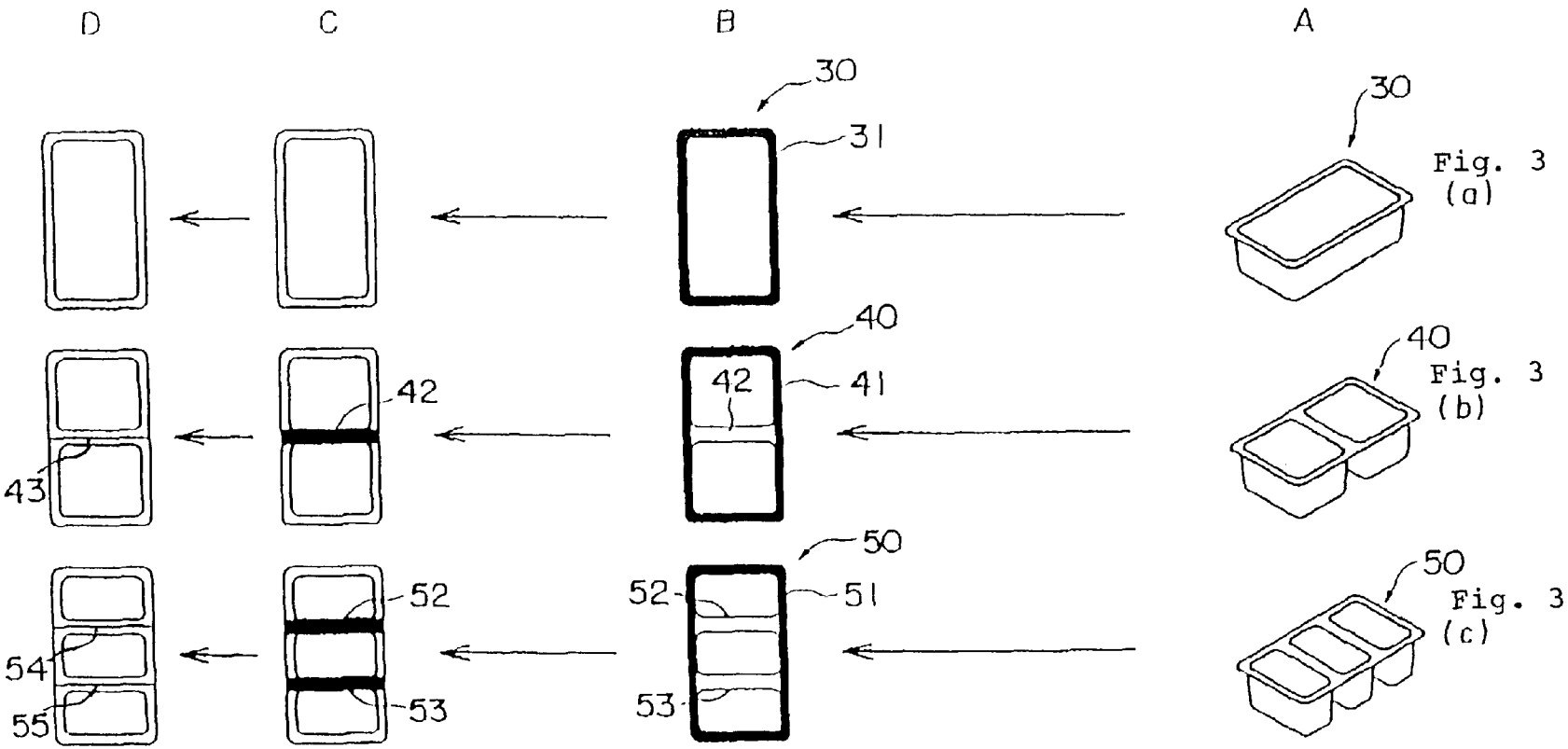
FIG. 3 is an explanatory view showing steps A to D for effecting packaging in the packaging apparatus of FIG. 1, wherein case (a) uses a single packaging material, case (b) uses a twin packaging material and case (c) uses a triple packaging material.

FIG. 3 is an explanatory view showing steps A to D for effecting packaging in the present packaging apparatus, wherein case (a) uses a single packaging material 30, case (b) uses a twin packaging material 40 and case (c) uses a triple packaging material 50. In FIG. 3, packaging steps in the multiple packaging device 1 are shown as a flow from step A to step B.

While the packaging material 30, 40, 50 coming out of the multiple packaging device 1 is sealed with the sheet placed thereon at the outer peripheral edge portion 31, 41, 51 thereof (black bold portions of step B of FIG. 3), in case of the multiple packaging materials of cases (b) and (c), the multiple packaging material is not sealed yet with the sheet at the adjacent side edge portion 42, 52, 53 between each of the goods filling sections.

The multiple packaging material coming out of the multiple packaging device 1 in the mentioned state enters the longitudinal sealing/scratching device 2. In this case, when the multiple packaging material is carried into the longitudinal sealing/scratching device 2 from the multiple packaging device 1, the multiple packaging material is guided at its outer peripheral edges on both sides by a guide 24.

Then, the multiple packaging material enters the longitudinal sealing portion 21 of the longitudinal sealing/scratching device 2 to be pinched together with the sheet upward and downward at the adjacent side edge portion 42, 52, 53 by the roll seal device so that the adjacent side edge portion 42, 52, 53 is sealed with the sheet placed thereon.

The mentioned state is shown in step C of FIG. 3 (black bold portions).

The multiple packaging material coming out of the longitudinal sealing portion 21 is then carried to the scratching portion 22. In the scratching portion 22, the cutters 25, 26 abut on the upper and lower surfaces of the adjacent side edge portion 42, 52, 53 of the multiple packaging material so that the cutter 25 on the upper side cuts the sheet which seals the adjacent side edge portion 42, 52, 53 and, at the same time, scratches the upper surface of the adjacent side edge portion 42, 52, 53. On the other hand, the cutter 26 on the lower side scratches the lower surface of the adjacent side edge portion 42, 52, 53 at the position corresponding to the scratched portion 43, 54, 55 of the upper surface of the adjacent side edge portion 42, 52, 53.

Thus, when the multiple packaging material comes out of the longitudinal sealing/scratching device 2, the adjacent side edge portion 42, 52, 53 has the scratched portion 43, 54, 55 on the upper nd lower surfaces thereof and the sheet covering the upper surface of the multiple packaging material is cut at the position of the scratched portion 43, 54, 55. The state of the multiple packaging material when it comes out of the longitudinal sealing/scratching device 2 is shown in step D of FIG. 3.

In the longitudinal sealing/scratching device 2, both the roll seal device of the longitudinal sealing portion 21 and the cutters of the scratching portion 22 are constructed changeable to meet the single packaging material, twin packaging material and triple packaging material, as the case may be, as shown by arrows in FIG. 2 so that the present packaging apparatus may be operated for any of the single packaging material and the multiple packaging material.

In case the single packaging material is used, it only passes through the longitudinal sealing/scratching device 2. It is to be noted that in FIG. 1, numeral 27 designates a guide, by which the multiple packaging material, after completed of the packaging, is guided at its outer peripheral edges on both sides to be discharged and numeral 28 designates a washing nozzle for washing the multiple packaging material, after completed of the packaging.

As mentioned above, in the multiple packaged goods coming out of the multiple packaging device 1 and the longitudinal sealing/scratching device 2, the packaging has the sheet cut at the adjacent side edge portion 42, 52, 53 between each of the goods filling sections as well as has the scratched portion 43, 54, 55 formed in the same adjacent side edge portion, so that the multiple packaged goods are easily separable when the multiple packaging material is bent at the scratched portion 43, 54, 55.

It is to be noted that although constructions of the packaging material carrying device, the sealer, etc. are not shown concretely in the embodiment as described above, those of the conventional packaging apparatus may be employed appropriately therefor.

While the invention has been described based on the embodiment as illustrated, the invention is not limited to the particular construction and arrangement thereof but, needless to mention, may be added with various modified forms thereof as come within the scope of the appended claims.

For example, while in the longitudinal sealing/scratching device 2 of the mentioned embodiment, the sealing of the adjacent side edge portion of the multiple packaging material and the sheet placed thereon is first done at the longitudinal sealing portion 21 and then the cutting of the sheet on the adjacent side edge portion and the scratching of the adjacent side edge portion are done at the scratching portion 22, the longitudinal sealing and the sheet cutting/scratching at the adjacent side edge portion may be done at the same time.

Also, while in the mentioned embodiment, the packaging apparatus which may use the single, twin and triple packaging materials is shown, the apparatus may be of a multiple packaging material exclusive type using a twin or more packaging material or may be applied to a case to effect packaging using a multiple packaging material of quadruple or more. In this case, the longitudinal sealing portion and the scratching portion are changed to meet the multiple packaging material.

Also, while in the mentioned embodiment, both the upper and lower surfaces of the adjacent side edge portion are scratched at the scratching portion 22, the construction of the scratching portion 22 may be such as to scratch either one of the upper and lower surfaces, as the case may be.

As described above, the present invention provides a packaging method using a multiple packaging material for obtaining multiple packaged goods by effecting packaging such that, where the multiple packaging material has a plurality of goods filling sections connected in series via an adjacent side edge portion between each of the goods filling sections, goods to be packaged are filled in the goods filling sections of the multiple packaging material and are packaged with the multiple packaging material being covered with a sheet and each of the goods filling sections is made separable at the adjacent side edge portion, characterized in comprising steps of;

sealing an overlapped portion of an outer peripheral edge portion of the multiple packaging material and the sheet;

then sealing the adjacent side edge portion of the multiple packaging material with the sheet; and cutting the sheet on the adjacent side edge portion as well as forming a scratched portion for separation in the adjacent side edge portion.

According to the packaging method of the present invention, the outer peripheral edge portion of the multiple packaging material and the sheet are sealed together and then the adjacent side edge portion of the multiple packaging material and the sheet are sealed together and the cutters are arranged to abut on the adjacent side edge portion so that the sheet on the adjacent side edge portion is cut and the adjacent side edge portion is scratched. Thus, the multiple packaged goods so obtained may be separated easily, with each of the goods filling sections remaining sealed as it is, when the multiple packaging material is bent at the adjacent side edge portion.

The packaging method of the present invention may be practiced easily only by using a conventional multiple packaging device, as it is, of a type to effect packaging by sealing an outer peripheral edge portion of a multiple packaging material with a sheet and adding downstream thereof a device to cut the sheet on the adjacent side edge portion of the multiple packaging material and to scratch the adjacent side edge portion.

Also, the present invention provides a packaging apparatus using a multiple packaging material, characterized in comprising; a multiple packaging portion for effecting packaging such that, where the multiple packaging material has a plurality of goods filling sections connected in series via an adjacent side edge portion between each of the goods filling sections, goods to be packaged are filled in the goods filling sections of the multiple packaging material and are packaged with the multiple packaging material being covered with a sheet, and with an overlapped portion of an outer peripheral edge portion of the multiple packaging material and the sheet being sealed; a longitudinal sealing portion for sealing an overlapped portion of the adjacent side edge portion of the multiple packaging material, which has come out of the multiple packaging portion, and the sheet; and a scratching portion for forming a scratched portion in the adjacent side edge portion.

According to the packaging apparatus of the present invention, in addition to a conventional multiple packaging device, provided is a device comprising the longitudinal sealing portion for sealing the overlapped portion of the adjacent side edge portion between each of the goods filling sections of the multiple packaging material and the sheet, and the scratching portion for forming the scratched portion in the adjacent side edge portion of the multiple packaging material, thereby the multiple packaging in which each of the goods filling sections may be separated easily can be realized.

Further, according to the packaging apparatus of the present invention in which the longitudinal sealing portion and the scratching portion for performing the sealing and scratching between each of the goods filling sections are constructed changeable for the single packaging material and the multiple packaging material, a packaging apparatus changeable for the conventional packaging using the single packaging material and the packaging using the multiple packaging material can be obtained.

What is claimed is:

1. A packaging apparatus using a multiple packaging material, comprising:

a multiple packaging portion for effective packaging such that, where said multiple packaging material has a plurality of goods filling sections connected in series via an adjacent side edge portion between each of side goods filling sections, goods to be packaged are filled in said goods filling sections of said multiple packaging material and are packaged with said multiple packaging material being covered with a sheet, and with an overlapped portion of an outer peripheral edge portion of said multiple packaging material and said sheet being sealed;

a longitudinal sealing portion being arranged downstream of said multiple packaging portion for sealing an overlapped portion of said adjacent side edge portion of said multiple packaging material, which has come out of said multiple packaging portion, and said sheet; and a scratching portion being arranged downstream of said longitudinal sealing portion for forming a scratched portion in said adjacent side edge portion, so that said adjacent side edge portion, when bent, may be easily separated at said scratched portion, wherein said longitudinal sealing portion and said scratching portion are provided both at a same time in a longitudinal scratching/sealing device which is located adjacent to said multiple packaging portion, and wherein said longitudinal sealing/scratching device further includes a washing nozzle configured to wash the multiple packaging material after completion of a packaging operation.

2. The packaging apparatus as claimed in claim 1, wherein said longitudinal sealing portion and said scratching portion are constructed so as to be quickly and easily changeable from using a single packaging material to using said multiple packaging material and vice versa.

3. The packaging apparatus of claim 2, wherein said longitudinal sealing/scratching device includes a roll seal device having a roller-shaped sealer configured to seal together the sheet and the adjacent side edge portions between each goods filling section of the multiple packaging material.

4. The packaging apparatus of claim 2, wherein said longitudinal sealing/scratching device further includes a guide configured to guide the multiple packaging material to a discharge location after completion of a packaging operation.

5. The packaging apparatus of claim 2, wherein said longitudinal sealing/scratching device further includes a control portion.

6. The packaging apparatus of claim 1, wherein said longitudinal sealing/scratching device includes a roll seal device having a roller-shaped sealer configured to seal together the sheet and the adjacent side edge portions between each goods filling section of the multiple packaging material.

7. The packaging apparatus of claim 1, wherein said scratching portion includes cutters for scratching the corresponding upper and lower surfaces of the adjacent side edge portions.

8. The packaging apparatus of claim 1, wherein said longitudinal sealing/scratching device further includes a guide configured to guide the multiple packaging material to a discharge location after completion of a packaging operation.

9. The packaging apparatus of claim 1, wherein said longitudinal sealing/scratching device further includes a control portion.

10. A packaging apparatus using a multiple packaging material, comprising:

a multiple packaging portion for effective packaging such that, where said multiple packaging material has a plurality of goods filling sections connected in series via an adjacent side edge portion between each of said goods filling sections, goods to be packaged are filled in said goods filling sections of said multiple packaging material and are packaged with said multiple packaging material being covered with a sheet, and with an overlapped portion of an outer peripheral edge portion of said multiple packaging material and said sheet being sealed;

a longitudinal sealing portion being arranged downstream of said multiple packaging portion for sealing an overlapped portion of said adjacent side edge portion of said multiple packaging material, which has come out of said multiple packaging portion, and said sheet; and a scratching portion being arranged downstream of said longitudinal sealing portion for forming a scratched portion in said adjacent side edge portion, so that said adjacent side edge portion, when bent, may be easily separated at said scratched portion, wherein said longitudinal sealing portion and said scratching portion are constructed so as to be quickly and easily changeable from using a single packaging material to using said multiple packaging material and vice versa, wherein said longitudinal sealing portion and said scratching portion are provided both at a same time in a longitudinal scratching/sealing device which is located adjacent to said multiple packaging portion, and wherein said longitudinal sealing/scratching device further includes a washing nozzle configured to wash the multiple packaging material after completion of a packaging operation.

11. The packaging apparatus of claim 10, wherein said longitudinal sealing/scratching device includes a roll seal device having a roller-shaped sealer configured to seal together the sheet and the adjacent side edge portions between each goods filling section of the multiple packaging material.

12. The packaging apparatus of claim 10,wherein said scratching portion includes cutters for scratching the corresponding upper and lower surfaces of the adjacent side edge portions.

13. The packaging apparatus of claim 10, wherein said longitudinal sealing/scratching device further includes a guide configured to guide the multiple packaging material to a discharge location after completion of a packaging operation.

14. The packaging apparatus of claim 10, wherein said longitudinal sealing/scratching device further includes a control portion.

* * * * *